United States Patent [19]

Hayashi

[11] Patent Number: 4,467,917

[45] Date of Patent: Aug. 28, 1984

[54] CARRIER TUBE FOR PRINTS, SHEETS OR ARTISTIC CANVASES

[76] Inventor: Keiichiro Hayashi, 31 Carol Rd., Westfield, N.J. 07090

[21] Appl. No.: 507,963

[22] Filed: Jun. 27, 1983

[51] Int. Cl.[3] ..... B65D 85/67; B65D 85/671

[52] U.S. Cl. ..... 206/412; 229/93

[58] Field of Search ..... 206/449, 412, 389, 1.7, 206/1.8; 229/93; 312/107

[56] References Cited

U.S. PATENT DOCUMENTS

| | | | |
|---|---|---|---|
| 1,973,114 | 9/1934 | Sherman | 206/412 |
| 2,738,121 | 3/1956 | Johnson | 229/93 |
| 2,871,080 | 1/1959 | Shelly | 312/107 |

FOREIGN PATENT DOCUMENTS

| | | | |
|---|---|---|---|
| 277471 | 9/1927 | United Kingdom | 229/93 |

*Primary Examiner*—William T. Dixson, Jr.

*Attorney, Agent, or Firm*—Robert S. Salzman

[57] ABSTRACT

A carrying or transporting tube for artistic prints, sheets, or canvas materials features a backing liner that protects the wound print within the tube and prevents the unwinding of the wound print.

The liner is comprised of a rectilinear section having a pouch on opposite ends thereof. The print to be transported is placed in the pouch of the liner, and the liner is wound and inserted into the carrying tube.

20 Claims, 6 Drawing Figures

CARRIER TUBE FOR PRINTS, SHEETS OR ARTISTIC CANVASES

FIELD OF THE INVENTION

This invention relates to carrier tubes for wound documents and prints, and more particularly to a new carrier device wherein the wound print will not unravel or unwind within the tube.

BACKGROUND OF THE INVENTION

The use of mailing tubes for transporting documents through the mails in well-known in the art. Such devices feature an inexpensive way to protect valuable documents and prints from the rigors of the mailing system, which is known to occasionally deliver our fragile enclosures in more than a single piece.

Transport tubes, despite their widespread use have several disadvantages. Documents placed within the tubes often become unwound, making their removal difficult. If rubber bands are used to maintain a tight sprial, the edges of the document can often experience a torn or ragged cut. Even when the documents are extracted from the tube intact, they often tend to remain curled, i.e. the printed materials tend to acquire a set. Flattening or straightening these prints may be a painstaking and time consuming experience, requiring weighting and counter-rolling.

The present invention has as one of its objectives to maintain the advantages of a carrier tube system, while eliminating the aforementioned drawbacks. The invention seeks to provide a carrier tube device which: (1) preserves the integrity of the document; (2) prevents the document from unwinding in the tube; (3) prevents tearing along the print edges; (4) facilitates the straightening and flattening of the rolled document; and (5) accomplishes the insertion and removal of the printed materials with respect to the carrier tube in a facile and easy manner.

DISCUSSION OF THE RELATED ART

A carrier tube having a display sheet in combination with the tube, is shown in U.S. Pat. No. 2,654,970; issued Oct. 13, 1953. In this invention, the display sheet is reinforced along its edges in order to stand upright with respect to the tube body.

While the present invention also features reinforcements along the edges of the scroll it is not for the same purpose. The invention discloses a protective liner which is reinforced to facilitate the flattening and straightening of the document wound inside the liner. The liner has as one of its objectives to protect the enclosed document.

In another U.S. patent, U.S. Pat. No. 3,395,789; issued: Aug. 6, 1968, it is taught that a tube of wound sheet material can be used as a core for winding a length of material thereon. This device differs from the present invention in that the mandrel or core for winding the document of the present invention is used in conjunction with a backing liner and carrying tube in order to safely and conveniently transport a document. In other words, the core used in the present invention is used to tightly wind the document contained in the backing liner which is then inserted into a carrier tube.

For the purpose of this invention, the terms "document" or "print" shall be defined as any sheet of material to be mailed, carried or transported, including such items as artistic canvases, paintings, drawings, photos, diplomas, certificates, awards, etc.

BRIEF SUMMARY OF THE INVENTION

The invention pertains to a carrying device for a print, sheet or artistic canvas. The device features a flexible liner having at least one pouch in which the print is inserted. The liner is addapted to be wound into a generally spiral shape. The liner and print are then inserted into a hollow-carrying tube. Securing means are provided to prevent the unraveling or unwinding of the wound liner when deposited in the tube. The securing means may be an end cap which is inserted over the wound liner, or it can be a coating of adhesive-like material. Such material may be a Velcro ® or pressure-sensitive tape applied to the back and edge of the liner.

A mandrel or core can also be used to facilitate the winding of the liner. The mandrel can be provided with a rib on each end for guiding the liner upon the mandrel, i.e. as a means to wind the liner in a straight spiral upon the core. The rib can be provided with a slot for locating and anchoring an edge of the liner upon the mandrel.

The liner may be provided with edge reinforcements to assist in flattening and straightening the wound liner and print.

It is an object of this invention to provide an improved carrier device for documents or prints;

It is another object of the invention to provide a carrying tube device that will feature the easy insertion and removal of the document from the tube, as well as the maintenance of the integrity and safety of the document.

These and other objects of this invention will become more apparent and will be better understood with reference to the following detailed description considered in conjunction with the accompanying drawings.

DETAILED DESCRIPTION OF THE INVENTION

Generally speaking, the invention features a device for carrying or transporting documents or prints. The device comprises a liner into which a document or print is inserted. The liner protects the print from damage as it is wound for insertion into a hollow mailing or transport tube. The device allows for ease of insertion and removal of the wound print from the hollow tube.

Figure 1:
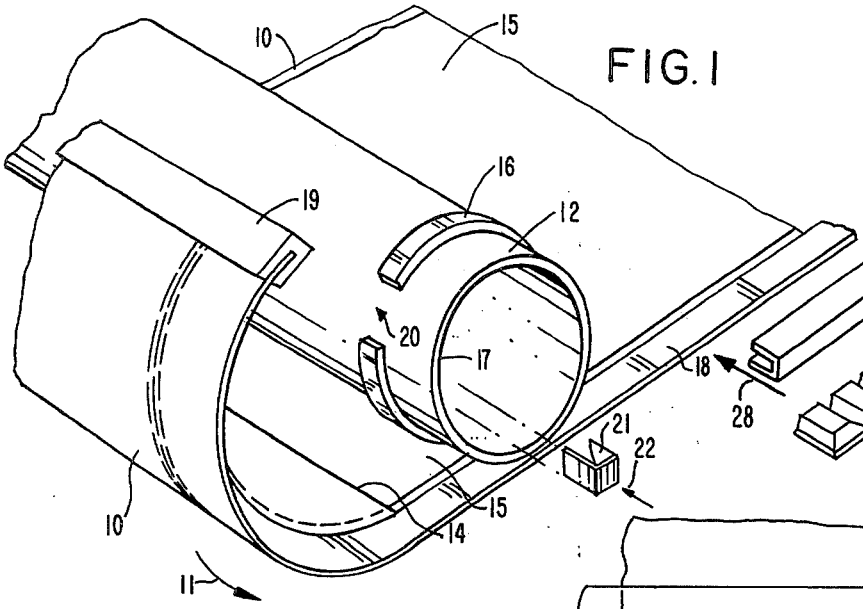
FIG. 1 is a perspective view of the mandrel and liner apparatus for the carrier device of this invention.
Figure 2:
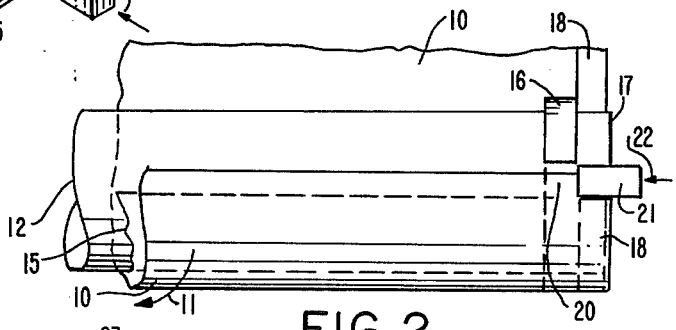
FIG. 2 is a front view of the apparatus shown in FIG. 1.

Now referring to FIGS. 1 and 2, a liner 10 is shown being wound (arrow 11) upon a mandrel 12. The liner 10 is typically comprised of flexible material such as vinyl plastic, mesh, or cloth. The liner 10 acts as a backing for the print or document to be placed in the hollow carrying tube 13, shown in FIG. 5.

Figure 3:
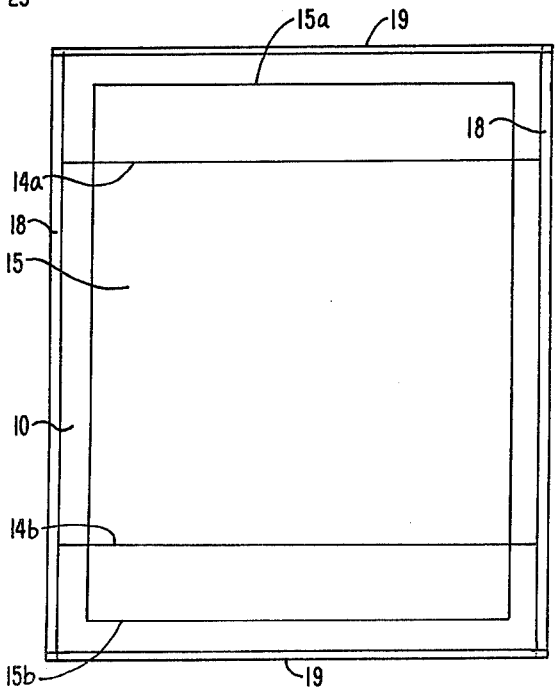
FIG. 3 is a plan view of the liner illustrated in FIGS. 1 and 2.

The liner 10 has two pouches 14 on each end thereof; designated 14*a* and 14*b* as more clearly shown in FIG. 3. The print or document 15 (FIG. 3) is placed inside the pouches, such that the document end 15*a* is inserted into pouch 14*a*, and the document end 15*b* is inserted into pouch 14*b*, respectively. In this fashion, the document 15 is captured by the liner 10 and becomes a temporary integral part of the liner.

As the liner 10, is wound (arrow 11) upon the mandrel 12 of FIGS. 1 and 2, the liner 10 will protect the document 15 from physical damage and moisture.

The mandrel or core 12 provides a means to wind the liner 10 tightly in a cylindrical or spiral shape. To insure a straightly wound liner 10, the mandrel is provided with a rib 16 disposed adjacent each end 17.

A corresponding rib or side reinforcement 18 which is made of elastic material is provided on each edge of the liner 10, which liner rib 18 aligns with the mandrel rib 16, so that the liner is caused to obtain a straightly wound start.

Figure 4:
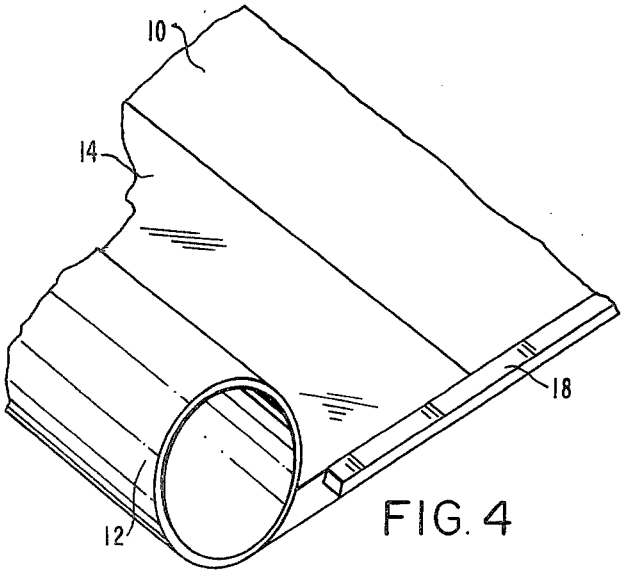
FIG. 4 is an alternate embodiment of the apparatus depicted in FIG. 1, showing a perspective view of the liner attached to the mandrel as an integral section thereof.

Referring to FIG. 4, wherein like designations are used for like elements, the liner 10 is fabricated as an integral part of the mandrel 12, such that the liner 10 is always straightly wound upon the mandrel 12. The liner rib 18 in this embodiment is used strictly for reinforcement and for spacing between layers.

Figure 5:
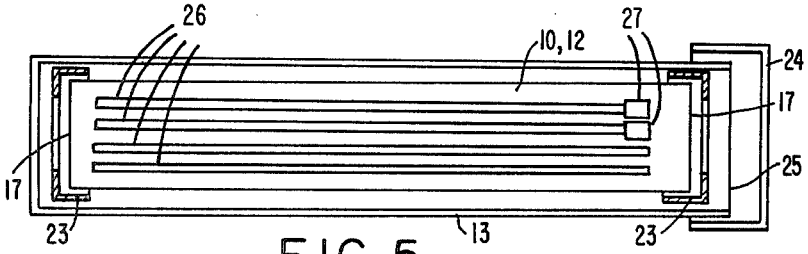
FIG. 5 illustrates a sectional view of the wound liner upon the mandrel as depicted in FIG. 1, and further depicting this apparatus as inserted within a hollow carrying tube.

As reinforcements, ribs 18 allow the liner to quickly regain a flat profile after the liner 10 is unwound from the mandrel 12. For displaying or for accelerating the flattening, stiff channels 26 are snugly placed over the ribs 18, as shown by arrow 28 in FIG. 1. These channels 26 may come in half side-lengths for storing inside the hollow mandrel 12, as shown in FIG. 5. Two of these channels 26 have enlarged end portions 27 on one end thereof, for overlapping.

End reinforcements 19 are placed over the liner 10, and are used to assist in the flattening of the liner 10 and document 15. The end reinforcements 19 also serve to locate and anchor the liner to the mandrel 12. This is accomplished by placing the reinforcement 19 into the corresponding slot 20 in ribs 16 of the mandrel. In this way, the liner 10 is firmly and securely located with respect to the mandrel 12.

A clip 21 can be optionally slid over (arrow 22) the end 17 of the mandrel 12 to hold the liner 10 in place.

Referring to FIG. 5, a liner 10 is wound upon a mandrel 12, and is inserted within a hollow carrying tube 13, as aforementioned. In order to insure the liner 10 from unraveling or unwinding, end caps 23 are placed over the ends 17 of the mandrel 12.

A cap 24 is also placed over the end 25 of tube 13 to seal-in the contents (document 15, liner 10 and mandrel 12).

The mandrel 12 may be disgarded, and the liner 10 held in wound condition by means of a Velcro® or other pressure-sensitive backing (not shown) which can be coated upon liner 10, as an optional feature.

Figure 6:
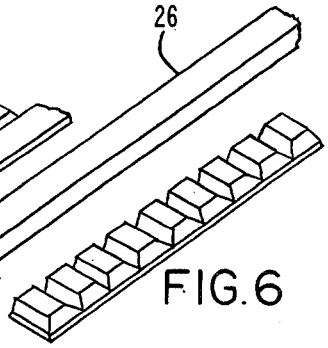
FIG. 6 is a perspective view of an alternate embodiment of the edge reinforcement for the liner shown in FIGS. 1 and 4.

Ribs 18 can be manufactured with a serrated or tank-track design, as shown in FIG. 6, in order to facilitate winding of the liner 10 and to eliminate need of the mandrel 12.

Having thus described the invention, what is desired to be protected by Letters Patent is presented by the following appended claims.

What is claimed is:

1. A transporting device for carrying a print, sheet or artistic canvas, comprising:
   - a liner having a pouch on opposite ends thereof for insertion of respective ends of a print, sheet or artistic canvas, said liner being comprised of flexible material for allowing said liner to be curled or wound into a generally spiral shape, so as to fit within a transporting tube;
   - means for securing said wound liner and preventing said wound liner from unwinding; and
   - a hollow tube for carrying an inserted, wound and secured backing liner containing said print, sheet or artistic canvas.

2. The transporting device of claim 1 further comprising a mandrel upon which said liner can be wound prior to insertion into said hollow tube.

3. The transporting device of claim 1, wherein said means for securing said wound liner comprises an end cap inserted over at least one end of said wound liner to prevent said liner from unwinding.

4. The transporting device of claim 2, wherein said mandrel has a rib disposed on each end thereof, for guiding the winding of said liner upon said mandrel.

5. The transporting device of claim 4, wherein each rib has a slot for locating and anchoring an edge of said liner upon said mandrel.

6. The transporting device of claim 1, wherein said liner can be provided with stiffeners when it is removed from said hollow tube and is unwound, said stiffeners being used to flatten said print, sheet or artistic canvas.

7. The transporting device of claim 1, wherein said liner comprises edge reinforcements on at least two sides thereof.

8. The transporting device of claim 1, wherein said liner is coated with a bondable fabric or adhesive to prevent unwinding from a wound position.

9. A carrying tube for a print, sheet or artistic canvas, comprising:
   - a liner having a pouch on opposite ends thereof for insertion of respective ends of a print, sheet or artistic canvas;
   - a mandrel for securely winding said liner thereupon; and
   - a hollow tube for carrying said mandrel and said liner wound thereupon, whereby a print, sheet or artistic canvas contained within said liner can be carried within said hollow tube without unwinding therein.

10. The carrying tube of claim 9, further comprising and end cap for insertion over each end of said mandrel after said liner is wound thereon, in order to prevent unwinding of said liner within said hollow tube.

11. The carrying tube of claim 9, wherein said mandrel has a rib disposed on each end thereof, for guiding the winding of said liner upon said mandrel.

12. The carrying tube of claim 11, wherein each rib has a slot for locating and securing an edge of said liner to said mandrel.

13. The carrying tube of claim 9, wherein said liner can be provided with stiffeners when it is removed from said hollow tube and is unwound, said stiffeners being used to straighten and flatten said print, sheet or artistic canvas.

14. The carrying tube of claim 9, wherein said liner comprises edge reinforcements on at least two sides thereof.

15. The carrying tube of claim 9, wherein said liner is coated with a bondable fabric or adhesive to prevent unwinding from a wound position.

16. A carrying device containing a print, sheet or artistic canvas, comprising:

a flexible liner having a pouch on at least one end thereof for insertion of said print, sheet or artistic canvas, said liner adapted to be wound into a generally spiral shape for insertion within a carrying tube;

securing means associated with said wound liner for preventing said wound liner from unwinding while deposited within said carrying tube; and a hollow carrying tube for insertion of said wound liner, said tube protecting the liner and print, sheet or artistic canvas contained therein.

17. The carrying device of claim 16, comprising a mandrel upon which said liner can be wound prior to insertion within said hollow carrying tube.

18. The carrying device of claim 16, wherein said securing means comprising at least one end cap for insertion over said wound liner.

19. The carrying device of claim 16 wherein said securing means comprises a coating upon said liner for bonding said liner in a wound position.

20. The carrying device of claim 16, wherein said liner comprises edge reinforcement means.

* * * * *